US010935039B2

(12) United States Patent
Kedelty et al.

(10) Patent No.: US 10,935,039 B2
(45) Date of Patent: Mar. 2, 2021

(54) BLOWER IMPELLER FOR A HANDHELD BLOWER

(71) Applicant: MTD PRODUCTS INC, Valley City, OH (US)

(72) Inventors: Dominic Kedelty, Valley City, OH (US); Maryam Khorshidi, Valley City, OH (US)

(73) Assignee: MTD PRODUCTS INC, Valley City, OH (US)

( * ) Notice: Subject to any disclaimer, the term of this patent is extended or adjusted under 35 U.S.C. 154(b) by 111 days.

(21) Appl. No.: 15/805,465

(22) Filed: Nov. 7, 2017

(65) Prior Publication Data

US 2019/0136866 A1 May 9, 2019

(51) Int. Cl.

| | |
|---|---|
| ***F04D 29/22*** | (2006.01) |
| ***F04D 29/28*** | (2006.01) |
| ***F04D 17/08*** | (2006.01) |
| ***F04D 17/16*** | (2006.01) |
| ***F04D 29/66*** | (2006.01) |
| ***F04D 29/30*** | (2006.01) |

(52) U.S. Cl.

CPC ..... *F04D 29/2216* (2013.01); *F04D 17/08* (2013.01); *F04D 17/162* (2013.01); *F04D 29/281* (2013.01); *F04D 29/30* (2013.01); *F04D 29/666* (2013.01); *F05D 2250/713* (2013.01)

(58) Field of Classification Search

CPC ..... F04D 29/30; F04D 29/281; F04D 29/666; F04D 29/2216; F04D 17/08; F04D 17/162; F05D 2250/713

USPC ..... 415/98, 101–102; 416/175, 184, 203

See application file for complete search history.

(56) References Cited

U.S. PATENT DOCUMENTS

| | | | | |
|---|---|---|---|---|
| 2,441,411 A | | 5/1948 | Hagen | |
| 3,904,308 A | * | 9/1975 | Ribaud | F04D 21/00 415/143 |
| 5,988,979 A | * | 11/1999 | Wang | F04D 29/283 416/178 |
| 6,003,199 A | | 12/1999 | Shaffer | |
| 6,059,541 A | * | 5/2000 | Beckey | A47L 5/14 417/295 |
| 6,736,610 B2 | | 5/2004 | Cifarelli | |

(Continued)

FOREIGN PATENT DOCUMENTS

| | | | |
|---|---|---|---|
| CN | 102996508 | | 3/2013 |
| CN | 102996508 A | * | 3/2013 |

(Continued)

OTHER PUBLICATIONS

Detent—Merriam-Webster Dictionary (Year: 2013).*

(Continued)

*Primary Examiner* — Nathaniel E Wiehe
*Assistant Examiner* — Brian O Peters
(74) *Attorney, Agent, or Firm* — Wegman Hessler

(57) ABSTRACT

A blower impeller having a plate with a first side surface, a second side surface, and an outer circumferential edge extending between the first and second side surfaces; a front blade series extending from the first side surface, the front blade series comprising a plurality of front fins, wherein each front fin includes a first radius of curvature and a second radius of curvature; and a rear blade series extending from the second side, the rear blade series comprising a plurality of rear fins.

19 Claims, 5 Drawing Sheets

(56) References Cited

U.S. PATENT DOCUMENTS

| | | | | |
|---|---|---|---|---|
| 7,246,997 | B2 * | 7/2007 | Liu | F04D 29/282 415/204 |
| 2004/0062648 | A1 * | 4/2004 | Makinson | B29C 45/14065 416/3 |
| 2013/0084187 | A1 * | 4/2013 | Wu | F04D 25/166 416/189 |

FOREIGN PATENT DOCUMENTS

| | | | | |
|---|---|---|---|---|
| CN | 203081855 | | 7/2013 | |
| DE | 202010008957 | U1 * | 5/2011 | F04D 17/105 |
| GB | 161464 | * | 4/1921 | |
| JP | 2002005085 | * | 1/2002 | |
| JP | 2002039095 | * | 2/2002 | |
| JP | 2013238175 | * | 11/2013 | |
| KR | 20050107974 | A * | 11/2005 | |

OTHER PUBLICATIONS

Machine translation of JP2002005085 (Year: 2002).*
Machine translation of JP2013238175 (Year: 2013).*
Machine translation of JP2002039095 (Year: 2002).*
International Search Report dated Jan. 16, 2019 in International Application No. PCT/US2018/056607, 11 pages.
Kobayashi et al., "Development of Low-Noise and Large Air Volume Type Blower Equipped with an Environment-Friendly Engine", Komatsu Technical Report, vol. 48, No. 149, 2002, pp. 29-34.

* cited by examiner

BLOWER IMPELLER FOR A HANDHELD BLOWER

FIELD OF THE INVENTION

The present invention is generally directed to a blower impeller, and more particularly, a blower impeller for use in a handheld blower apparatus.

BACKGROUND OF THE INVENTION

It is known that in many applications, such as in the agricultural field, when cleaning of streets and pavements or grasslands is concerned, as well as for other similar applications, portable blowing apparatus are used which are adapted to produce a strong air jet.

In these applications, a blowing apparatus generally comprises a power source (electric, battery, or gas-powered) moving a centrifugal impeller wheel adapted to generate directed air flow. The impeller wheel is externally surrounded by a volute header adapted to convey the air flow. Part of the air flow is often deviated from the provided main use and conveyed towards the power source sometimes contained at least partly in a casing, for cooling of the engine itself.

However, these applications have some important drawbacks. First and foremost, they are characterized by a non-optimal yield because the air flow is not completely conveyed towards the use means provided for the blowing apparatus, but it is partly deviated for heat extraction. Part of the used energy is therefore employed for merely achieving a correct power source operation and the air flow really utilized has a smaller flow rate than that emitted from the impeller.

Also, it should be also pointed out that power source cooling by means of an overpressure air flow is often of poor efficiency; in fact, due to flow resistance to which the air flow is submitted while passing through often tortuous passageways between the power source and casing, overpressure is reduced or eliminated, which will therefore decrease the air outflow. Additionally, if the engine is not provided with a casing for improving cooling thereof, it produces a strong noise often higher than limits allowed by certain regulations against sound pollution.

Thus, what is needed in the art is an efficient blower impeller for use in a handheld blower.

BRIEF SUMMARY OF THE INVENTION

Generally described hereinafter is blower impeller. The blower impeller comprises a plate having a first side surface, a second side surface, and an outer circumferential edge extending between the first and second side surfaces; a front blade series extending from the first side surface, the front blade series comprising a plurality of front fins, wherein each front fin includes a first radius of curvature and a second radius of curvature; and a rear blade series extending from the second side, the rear blade series comprising a plurality of rear fins.

According to one aspect of the invention, the first side surface further comprises a central hub having a detent and a sloped transition portion. In some embodiments, the sloped transition portion comprises a gradient, the gradient transitioning radially outward from the central hub toward the outer circumferential edge. In some embodiments, the first side surface includes a substantially flat portion extending radially from the outer circumferential edge to substantially adjacent the central hub. In some embodiments, the sloped transition portion includes a substantially linear plane, a concave-sloping plane or a convex-sloping plane.

In some embodiments, the blower impeller further comprises a cylindrical projection, wherein the cylindrical projection is centrally located on the second side surface and extends perpendicularly therefrom. In some embodiments, the first radius of curvature and the second radius of curvature are different. In some embodiments, the number of rear blades in the rear blade series is different from the number of front blades in the front blade series. In some embodiments, the front blade series includes 18 front blades and the rear blade series includes 36 rear blades.

In yet another aspect of the present invention, the blower impeller comprises a plate having a first side surface, a second side surface, and an outer circumferential edge extending between the first side surface and the second side surface; a front blade series extending from the first side surface, the front blade series comprising a plurality of front fins, wherein each front fin includes a first radius of curvature and a second radius of curvature, wherein the first radius of curvature is directed toward a rotational direction and the second radius of curvature is directed away from the rotational direction; and a rear blade series extending from the second side, the rear blade series comprising a plurality of rear fins.

In some embodiments, the first side surface further comprises a central hub having a detent and a sloped transition portion. In some embodiments, the plurality of front fins extend radially inward from the outer circumferential edge toward the central hub. In some embodiments, each front fin includes a first interior tapered edge directed toward the central hub, a first exterior perpendicular edge extending from the outer circumferential edge, and a first top edge extending between the first interior tapered edge and the first exterior perpendicular edge. In some embodiments, the first interior tapered edge extends from the first side surface and increases in height toward the outer circumferential edge. In some embodiments, the first top edge has a first height adjacent to the first tapered edge and a second height adjacent to the outer circumferential edge, wherein the first height is greater than the second height. In some embodiments, each rear fin includes a second interior tapered edge, a second outer perpendicular edge, and a second top edge extending between the second interior tapered edge and the second outer perpendicular edge, each rear fin being substantially curved toward the rotational direction. In some embodiments, the first exterior perpendicular edge the front fins is aligned with one of the second exterior perpendicular edges on one of the rear fins. In some embodiments, the front blade series includes between 5-50 front fins.

According to yet another aspect of the present invention, a handheld blower is provided. The handheld blower comprises a housing having a first air inlet, a second air inlet, and an output port; a power source positioned within the housing; and a blower impeller positioned within the housing, the blower impeller having: a plate having a first side surface, a second side surface, and an outer circumferential edge extending between the first and second side surfaces; a front blade series extending from the first side surface, wherein the front blade series provides a first pressurized air flow, the front blade series comprising a plurality of front fins, wherein each front fin includes a first radius of curvature curved toward a rotational direction, and an angled tip having a second radius of curvature curved away from the rotational direction; and a rear blade series extending from the second side, wherein the rear blade series provides a second pressurized air flow, the rear blade series comprising a plurality of rear fins.

In some embodiments, the angled tip directs air off the front fins in a direction opposite to the rotational direction, and the rear fins direct air toward the rotational direction. In some embodiments, the blower impeller operates at a speed of less than about 7400 rpm and produces less than about 65 decibels (dB) of sound. In some embodiments, the front fins generate a first sound frequency and the rear fins 16*a* generate a second sound frequency. In some embodiments, the first sound frequency is about 1800 Hz and the second sound frequency is about 3600 Hz.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

These and other features of the present invention, and their advantages, are illustrated specifically in embodiments of the invention now to be described, by way of example, with reference to the accompanying diagrammatic drawings, in which.

Figure 1:
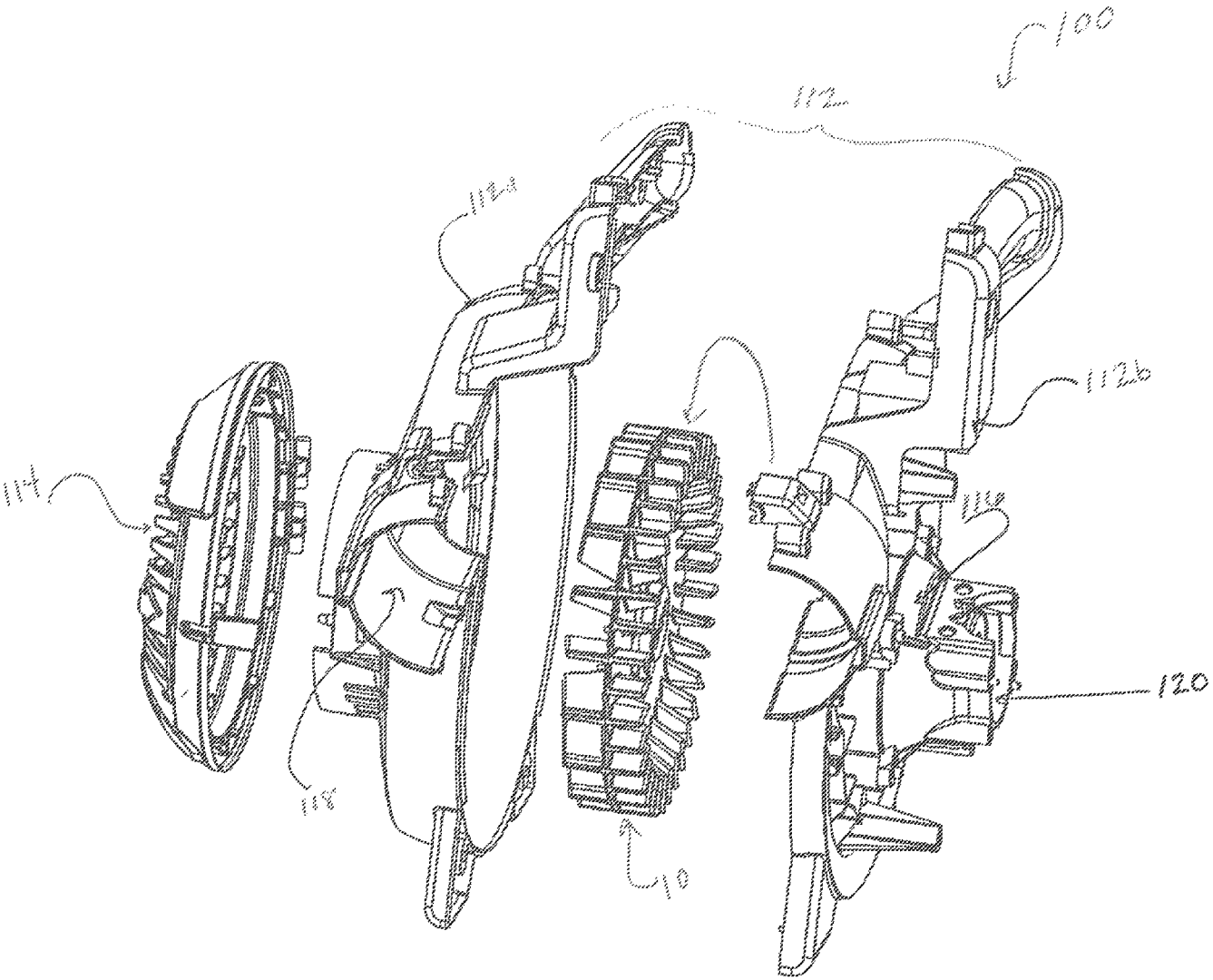
FIG. 1 is an exploded view of the blowing apparatus illustrated in one embodiment of the present invention.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

The present invention generally provides a blower impeller that can generate less noise compared to traditional blowers and can be used in handheld blower applications. Generally, as shown in FIG. 1, the blower apparatus 100 of the present invention includes a housing 112, having a first housing portion 112*a*, a second housing portion 112*b*, a first air inlet 114, a second air inlet 116, and an output port 118.

In some embodiments, the housing 112 may be comprised of two halves, a first housing portion 112*a* and a second housing portion 112*b*, mated together to form a single casing. The housing 112 is fluidly connected to both first air inlet 114 and second air inlet 116, thereby providing a continuous pathway between both the first inlet 114 and second inlet 116 and the outlet port 118, as shown in FIG. 1.

A power source 120 and a blower impeller 10 are also positioned within the housing 112. It should be noted that "blower apparatus", "blowing apparatus", and "handheld blower" may be used interchangeably throughout. In some embodiments, the power source 120 is an internal combustion engine. It should be understood by one having ordinary skill in the art that the power source 120 may also be an engine having a push-button start, an electric motor powered by a rechargeable battery, a replaceable battery, an A/C-powered electric motor, or any other power source capable of providing sufficient power to operate the blower apparatus 100.

The first air inlet 114 and the second air inlet 116 each include a different purpose. The first air inlet 114 provides the main suction intake, where a front blade series 14 pulls in a majority of the air that is used for the blowing application. In some embodiments, the front blade series 14 pulls in about 350 CFM from the first air inlet 114.

The second air inlet 116, located behind the blower impeller 10 where the drive shaft connects to the engine (not shown in figures), provides cooling air for the engine or power source, where the rear blade series 16 pulls a significant amount of air across the engine. In some embodiments, the rear blade series 16 pulls at least about 10-15% of the total usable air flow or at least about 40-60 CFM.

In contrast to systems that syphon air from the volute for cooling, due to this "double pump" design of the present invention, the cooling air contributes to the usable blowing air and to the total blowing performance of the blower apparatus 100. In some embodiments, the front blade series 14 contributes at least about 350 CFM and the rear blade series 16 contributes about 40 CFM, for a total blowing volume flow rate of at least about 390 CFM.

Figure 2:
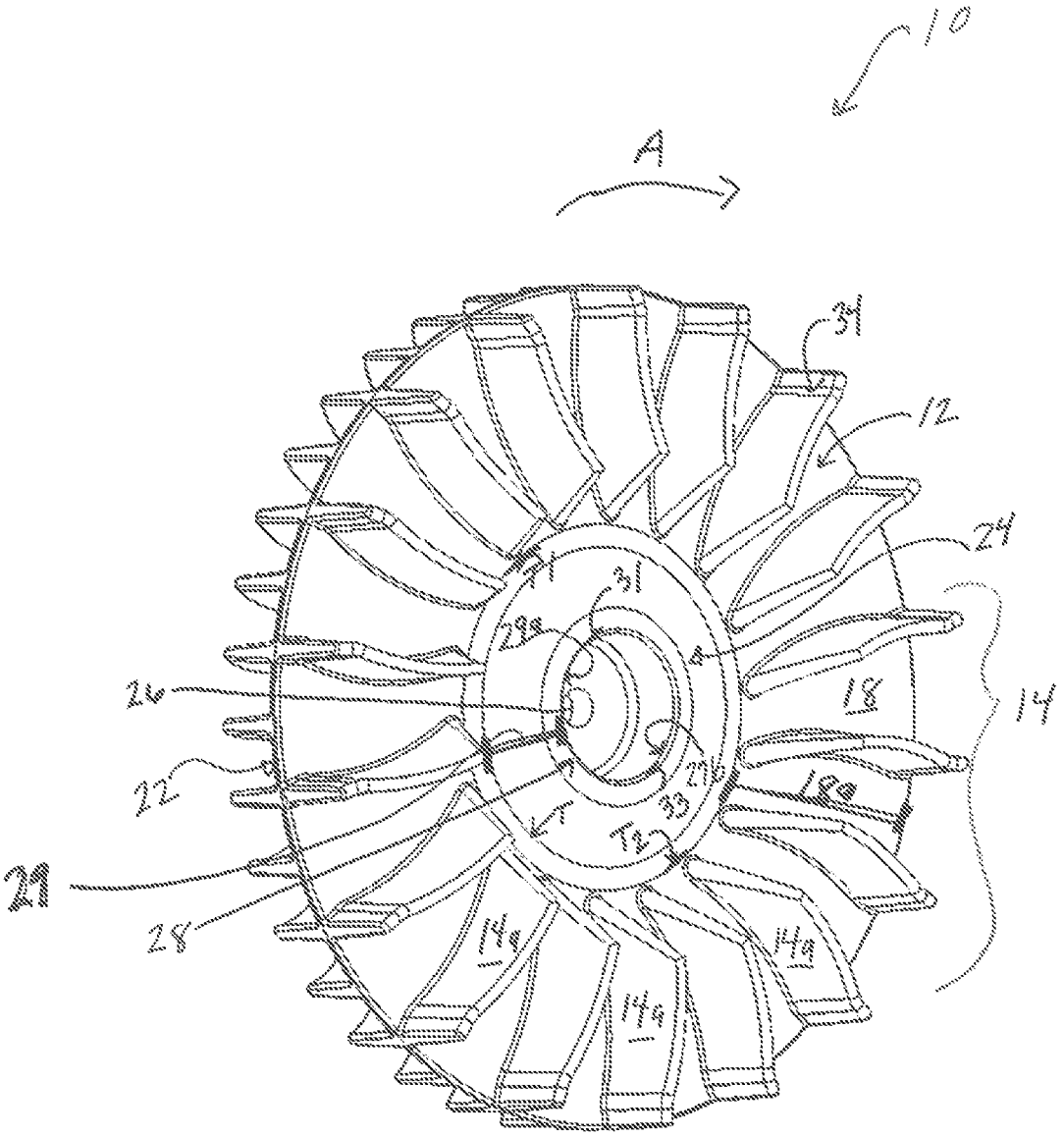
FIG. 2 is a partial rotated view of one embodiment of the present invention.
Figure 3:
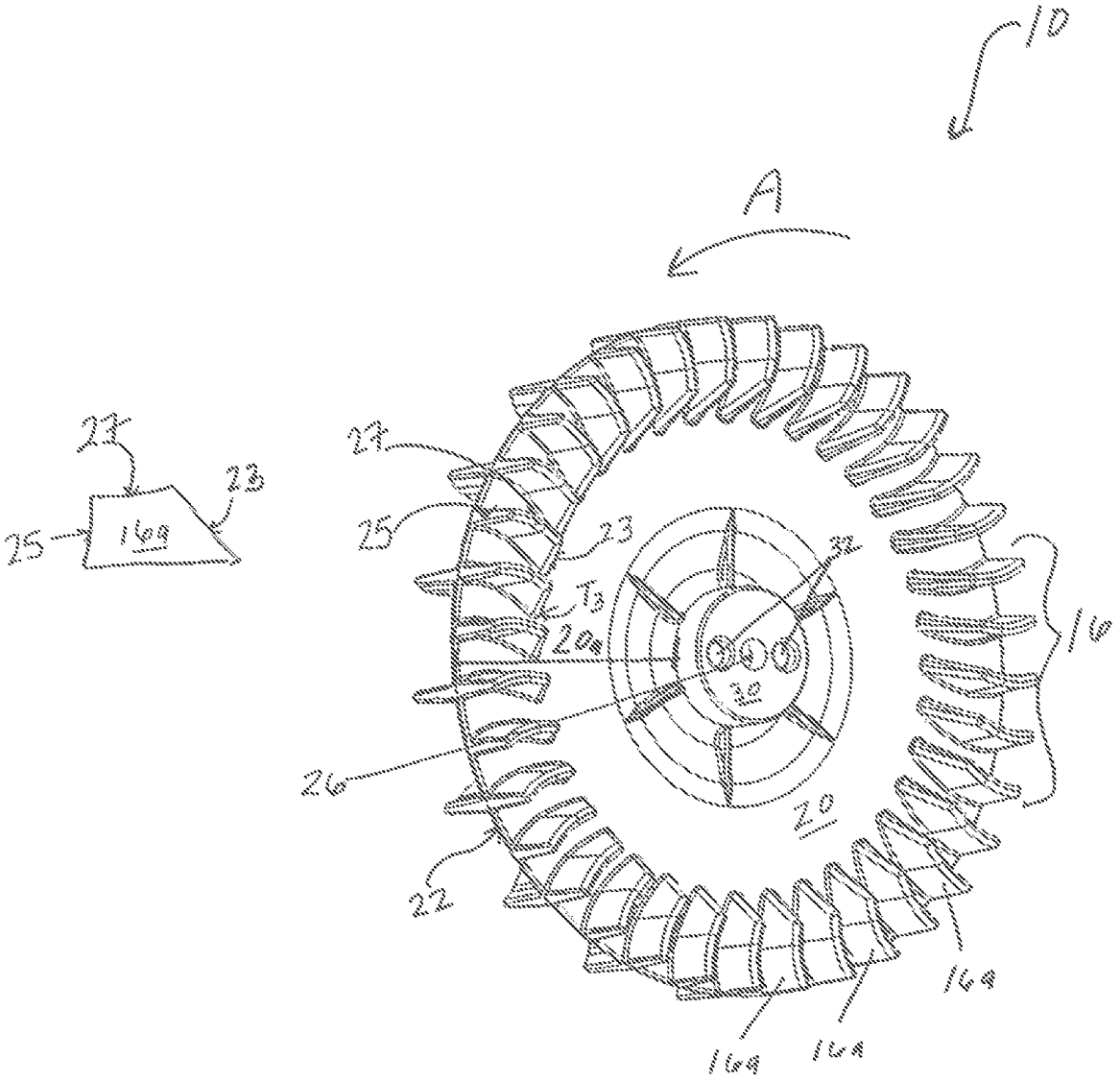
FIG. 3 is a partial rotated view of one embodiment of the present invention.

Now referring to FIGS. 2 and 3, an exemplary embodiment of the blower impeller 10 is shown. The blower impeller 10 comprises a plate 12, a front blade series 14, and a rear blade series 16. The plate 12 includes a first side 18, a second side 20, and an outer circumferential edge 22. When assembled, the front blade series 14 is facing toward the first air inlet 114, and the rear blade series 16 is facing toward the power source 120 and the second air inlet 116.

Both the front blade series 14 and the rear blade series 16 of blower impeller 10 of the present invention are formed as separate centrifugal impellers that are joined together (or integrally formed together) as one single structure having two opposing blade series. Centrifugal impellers are configured to have a plurality of impeller blades or fins that extend radially outward from a central hub to an outer circumferential edge. Upstream air is drawn toward the central hub of the centrifugal impeller, wherein the impeller blades or fins are aligned and oriented to redirect the airflow radially outward in a centrifugal manner. The blades of a centrifugal impeller are typically positioned against a plate (or between a pair of parallel plates) that likewise extends from the central hub, wherein the plate prevents axial movement of the air flow, thereby generally confining the air flow to radial flow. In some embodiments, the blower impeller 10 can be used in such applications as handheld blowers, HVAC systems, hair dryers, cooling/heating industrial machines, and/or the like, where the desired air flow is radially outward from the impeller.

As shown in FIGS. 2-3, the plate 12 is substantially circular, having a first side 18 and a second side 20. The plate 12 is formed as an integrally-formed, one-piece member of molded plastic. It should be understood that the plate 12 can be formed of any material sufficient to be rigid enough to produce substantial airflow, while also being lightweight. In some embodiments, the first side 18 is formed separately from the second side 20, wherein the first side 18 and the second side 20 are attached or integrally formed together to form the plate 12.

The first side 18 further includes a first side surface 18*a* and a central hub 24. The first side surface 18*a* includes a flat portion which extends radially inward from the outer circumferential edge 22 towards the central hub 24. The central hub 24 surrounds an aperture 26 for receiving and operatively connecting the blower impeller 10 to a drive shaft (not shown in figures). The aperture 26 extends from the first side 18 through to the second side 20.

The central hub 24 further includes a detent 28 and a sloped transition portion 29. The detent 28 is centrally located around the aperture 26 and is defined by a first wall 29*a* and a second wall 29*b*. The first wall 29*a* is formed from a first transition extending radially inward substantially from the first planar plate transition T1 toward the aperture 26, increasing in height with respect to the first side surface 18*a*, and stopping at a first apex 31, wherein the first wall 29*a* extends perpendicularly from the first apex 31 toward the aperture 26.

The second wall 29*b* is formed from a second transition extending radially inward substantially from the second planar plate transition T2 toward the aperture 26, increasing in height with respect to the first side surface 18*a*, and stopping at a second apex 33, where the second wall 29*b* extends perpendicularly from the second apex 33 toward the aperture 26.

The aperture 26 and the detent 28 are surrounded by the sloped transition portion 29. The sloped transition portion 29 includes a gradient extending radially inward and transitioning from the first side surface 18*a* toward the detent 28. The sloped transition portion 29 includes a transition T, which is substantially located where the gradient transitions from the first side surface 18*a*. In some embodiments, the sloped transition portion 29 includes a substantially linear sloped plane. In other embodiments, the sloped transition portion 29 includes a concave-sloping plane, and in other embodiments, a convex-sloping plane.

As shown in FIG. 3, the plate 12 additionally includes a second side 20 that is substantially planar. The second side 20 includes a cylindrical projection 30 centrally located around the aperture 26 and extends perpendicularly from the substantially planar second side 20. The cylindrical projection 30 further includes the aperture 26 and a pair of detents 32. The pair of detents 32 is configured for receiving and operatively connecting the blower impeller 10 to a drive shaft (not shown in figures).

Figure 4:
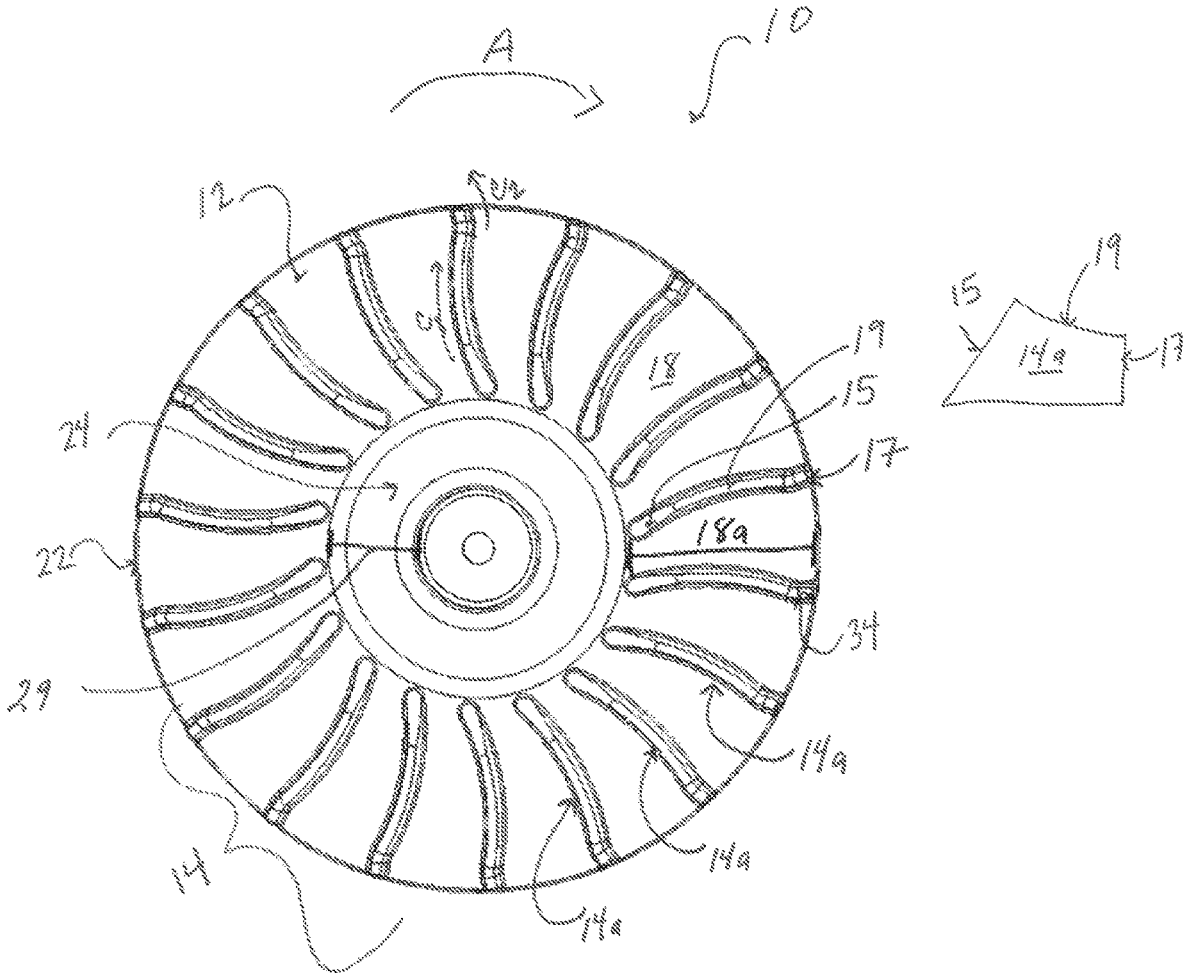
FIG. 4 is a front view of the embodiment as in FIG. 2.

Referring now to FIG. 4, the front blade series 14 is positioned on the first side 18 and includes a plurality of front fins 14*a* adjacent to the first side surface 18*a*. Each front fin 14*a* includes an interior tapered edge 15, and exterior perpendicular edge 17, and a top edge 19.

Each front fin 14*a* extends substantially from the outer edge of the sloped transition portion 29, extending radially to the outer circumferential edge 22. Each front fin 14*a* is disposed perpendicularly on the first side 18 of the plate 12 and extends longitudinally along the first side surface 18*a*.

The interior tapered edge 15 includes an angled or tapered edge and is substantially located around the central hub 24. The interior tapered edge 15 begins substantially at the outer edge of the sloped transition portion 29, increasing in height until it meets at the top edge 19 of the front fin 14*a*.

The exterior perpendicular edge 17 of each front fin 14*a* is perpendicular to the outer circumferential edge 22 and abuts with the first side surface 18*a*. In some embodiments, the exterior perpendicular edge 17 on each front fin 14*a* is aligned with an exterior perpendicular edge 25 on a rear fin 16*a*. In other embodiments, the exterior perpendicular edge 17 of the front fins 14*a* are offset (in a non-aligned manner) relative to the exterior perpendicular edge 25 of the rear fins 16*a* (not shown).

The top edge 19 extends longitudinally between the interior tapered edge 15 and the exterior perpendicular edge 17. The top edge 19 is angled such that the height is smaller at the exterior perpendicular edge 17 than at the interior tapered edge 15, relative to the plate 12 surface. In some embodiments, the top edge 19 is linear, and in other embodiments, the top edge 19 is non-linear.

As shown in FIG. 4, in some embodiments, each front fin 14*a* includes a first radius of curvature $C_1$ and a second radius of curvature $C_2$. In some embodiments, the first radius of curvature $C_1$ and the second radius of curvature $C_2$ are different. In some embodiments, the first radius of curvature $C_1$ is greater than the second radius of curvature $C_2$. In other embodiments, the first radius of curvature $C_1$ is less than the second radius of curvature $C_2$. In some embodiments, the first radius of curvature $C_1$ is directed toward the direction of rotation A and the second radius of curvature $C_2$ is directed away from the direction of rotation A.

The top edge 19 of each front fin 14*a* includes an angled tip 34. As shown in FIGS. 2 and 4, the front fins 14*a* are slightly curved toward the direction (i.e. having a forward curve) of rotation A, as shown by the arrow. The angled tip 34 is angled away from the direction of rotation A and away from the slight curve of each front fin 14*a*. In some embodiments, the top edge 19 has a different radius of curvature than the angled tip 34. The angled tip 34 on each front fin 14*a* reduces air separation from the impeller blades, which results in a reduction of noise generated. The forward curve in each front fin 14*a* allows for the air flow to be increased, while operating at lower revolutions per minute ("RPM").

Figure 5:
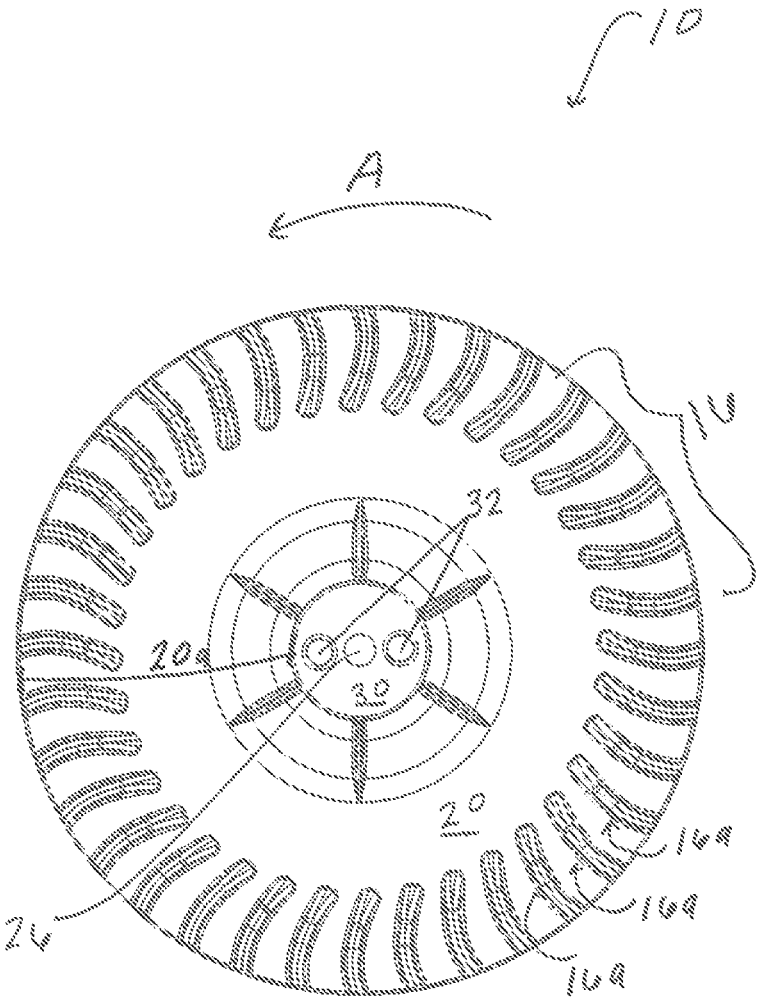
FIG. 5 is a rear view of the embodiment as in FIG. 3.

Now referring to FIGS. 3 and 5, the rear blade series 16 is positioned on the second side 20, and includes a plurality of rear fins 16*a* adjacent to the plate 12 surface. The second side 20 further includes a second side surface 20*a*, which is a substantially flat portion of the second side 20 that extends radially inward from the outer circumferential edge 22 to the edge of the cylindrical projection 30.

Each rear fin 16*a* includes an interior tapered edge 23, and outer perpendicular edge 25 and a top edge 27. Each rear fin 16*a* extends from the outer circumferential edge 22, extending radially inward substantially toward the cylindrical projection 30. Each rear fin 16*a* is disposed perpendicular to the second side 20 of the plate 12 and extends longitudinally along the second side surface 20*a*.

The interior tapered edge 23 includes an angled or tapered edge and is substantially located around the cylindrical projection 30. The interior tapered edge 23 begins from a transitional point T3, increasing in height until it meets at the top edge 27 of the rear fin 16*a*.

The top edge 27 extends longitudinally between the interior tapered edge 23 and the exterior perpendicular edge 25. The top edge 27 is linear such that the height is equivalent at the outer perpendicular edge 25 as it is at the interior tapered edge 23, relative to the plate 20 surface. In some embodiments, the top edge 27 is linear, and in other embodiments, the top edge 27 is non-linear.

As shown in FIGS. 3 and 5, each rear fin 16*a* is substantially curved toward the direction of rotation A. As shown in the illustrated embodiment, the rear fins 16*a* do not include an angled tip. It should be understood to one skilled in the art that the rear fins 16*a* can include an angled tip similar to the front fins 14*a*.

In one embodiment of the present invention, the front fins 14*a* and the rear fins 16*a* are of different dimensions or sizes. In some embodiments, the front fins 14*a* are generally larger than the rear fins 16*a*. In some embodiments, the front fins 14*a* are generally longer than the rear fins 16*a*.

In some embodiments, the front blade series 14 includes between 5-50 front fins 14*a*. In some embodiments, the rear blade series 16 includes between 5-50 rear fins 16*a*. In some embodiments, the number of rear fins 16*a* in the rear blade series 16 is a multiple of the number of front fins 14*a* in the front blade series 14. In other embodiments, the number of rear fins 16*a* is the same as the number of front fins 14*a*, wherein all of the rear fins 16*a* are aligned with all of the front fins 14*a*, or all of the rear fins 16*a* are offset with respect to all of the front fins 14*a*. In some embodiments, the number of rear fins 16*a* in the rear blade series 16 is different from the number of front fins 14*a* in the front blade series 14. In the illustrated embodiment, the front blade series includes eighteen (18) front fins and the rear blade series includes thirty-six (36) rear fins.

In contrast to other conventional blowing apparatuses, the blower impeller 10 illustrated in the figures operates at a slower rotational speed while providing the same output air speeds with less noise generated from the blower impeller 10.

In operation, the output rotational speed of the blower impeller 10 is controlled by the power source 120 that rotates a drive shaft (not shown in figures) which, in turn, rotates the blower impeller 10. The front blade series 14 is configured to provide a first pressurized air flow to cause air to be blown circumferentially through the volute in the housing 112. Accordingly, the rear blade series 16 is configured to provide a second pressurized air flow causing air to be drawn into the second air inlet 116 and over the engine 120, thus cooling the engine.

In an exemplary embodiment, the blower apparatus 100 can be operated at lower speeds than other conventional blowers. By reducing the output rotational speed of the blower impeller 10, the blower apparatus 100 will exhibit a reduction in the overall noise or sound level during operation, yet still exhibiting the same or better performance as a conventional blower.

For example, as shown in the illustrated embodiments of FIGS. 4-5, the front blade series 14 includes a smaller number of fins 14*a* than in the rear blade series 16, which contributes to the overall reduction in noise or sound level. The impeller noise generated by each blade series on the blower impeller 10 is calculated by number of fins multiplied by the rotational speed (i.e. revolutions of the impeller per second), so that the noise generated (i.e. sound level) does not double in amplitude. Different fin counts on opposing sides of the blower impeller 10 generate two distinct sound levels.

The front fins 14*a* generate a first sound frequency and the rear fins 16*a* generate a second sound frequency. Sound frequency (or sound energy) is measured over a broad frequency range and measured in Hertz (Hz). The overall level of sound is obtained by the sum of all frequencies, which can usually be broken down into separate octave bands (measured in decibels (dB) per octave band). In some embodiments, the first sound frequency is different from the second sound frequency. In some embodiments, two distinct sound levels produced by the different fin counts fall into two different octave bands, and therefore, are not amplified, but rather perceived distinctly.

In one exemplary embodiment, the geometry of the front fins 14*a* and the rear fins 16*a* substantially allow for the blower impeller 10 to be operated at a slower rotational speed, thus generating less overall noise. In some embodiments, the blower impeller 10 operates at a speed less than about 7500 rpm. In some embodiments, the blower impeller 10 operates at a speed of about 5500-6500 rpm.

By having differing scale-lengths on the front fins 14*a* and the rear fins 16*a*, the larger front fins 14*a* will produce larger turbulent eddies than those produced by the smaller rear fins 16*a*. Thus, contrary to other known impellers, which compound the result, the combination of the larger and smaller eddies result in a mixing effect that is believed to cause the smaller turbulent eddies to breakdown the larger turbulent eddies, thus effectively reducing the noise or sound.

In one exemplary embodiment of the invention, the front blade series 14 directs air flow in one direction, and the rear blade series 16 directs air flow in the opposite direction. As previously discussed, the front fins 14*a* and the rear fins 16*a* each have a different radius of curvature. Generally, due to the angled tip 34, air is directed off of the front fins 14*a* in a direction opposite to the direction of rotation A. To the contrary, the air flow produced by the rear fins 16*a* is directed toward the direction of rotation A. Thus, each blade series produces an air flow in opposite directions, which allows for a mixing effect to occur when air leaves the blower impeller 10 and contributes to the reduction in noise or sound level.

Since the pressurization is generated by both sides of the impeller, the air is mixed as it leaves the outer edge of each side (mixing effect), and the mixing of the air breaks large swirling flows generated by each side, therefore, reducing the overall sound generated by the impeller. As such, the noise or sound level produced by the combination of the two sound frequencies is the sum of the sound pressure levels (i.e. the sound sensed by an individual's ears), and the total noise is less than the sum of the two amplitudes, resulting in a more pleasant, and overall quieter noise. In some embodiments, the total frequency produced is similar or close to that of the power source.

The mixing effect of the present invention arises by the separate sound frequencies produced by the front fins 14*a* and the rear fins 16*a*. Due to the angled tip 34, air is directed off the front fins 14*a* in one direction and produces a first blade frequency. Additionally, air is directed in the opposite direction off of the rear fins 16*a*, thus producing a second blade frequency.

In some embodiments, the first blade frequency is about 1800 Hz and the second blade frequency is about 3600 Hz. In some embodiments, the first blade frequency and the second blade frequency fall into two separate octave bands, where the resulting sound value is quieter than the two amplitudes summed. In such embodiments, the blower impeller 10 produces less than about 65 decibels (dB) of sound.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A blower impeller, comprising: a planar plate having a first side surface, a second side surface, and an outer circumferential edge extending between the first side surface and the second side surface, wherein the first side surface comprises a central hub having a detent and a flat portion, and the second side surface comprises a cylindrical projection centrally located on the second side surface and extends perpendicularly therefrom; a front blade series extending from the first side surface, wherein said first side surface comprises a sloped transition portion, the front blade series comprising a plurality of front fins, wherein each front fin includes a first radius of curvature and a second radius of curvature, wherein the first radius of curvature is directed toward a rotational direction and the second radius of curvature is directed away from the rotational direction; and a rear blade series extending from the second side surface, the rear blade series comprising a plurality of rear fins, said plurality of rear fins are positioned toward the outer circumferential edge, wherein said second side surface comprises a gap located between the cylindrical projection and the plurality of rear fins.

2. The blower impeller as in claim 1, wherein each front fin includes a first radius of curvature and a second radius of curvature, wherein each front fin comprises an interior tapered edge extending from an outer edge of said sloped transition portion, an outer perpendicular edge, and a top edge, wherein said top edge is angled such that the height is smaller at the outer perpendicular edge than at the interior tapered edge relative to the first side surface.

3. The blower impeller as in claim 1, wherein the sloped transition portion comprises a gradient, the gradient transitioning radially outward from the central hub toward the outer circumferential edge.

4. The blower impeller as in claim 3, wherein the first side surface includes a substantially flat portion extending radially from the outer circumferential edge to substantially adjacent the central hub.

5. The blower impeller as in claim 3, wherein the sloped transition portion includes a substantially linear plane, a concave-sloping plane, or a convex-sloping plane.

6. The blower impeller as in claim 1, wherein the first radius of curvature and the second radius of curvature are different.

7. The blower impeller as in claim 1, wherein the number of rear fins in the rear blade series is different from the number of front fins in the front blade series.

8. The blower impeller as in claim 7, wherein the front blade series includes 18 front fins and the rear blade series includes 36 rear fins.

9. The blower impeller as in claim 1, wherein the plurality of front fins extend radially inward from the outer circumferential edge toward the central hub.

10. The blower impeller as in claim 1, wherein the interior tapered edge extends from the first side surface and increases in height toward the outer circumferential edge.

11. The blower impeller of claim 1, wherein the top edge extends between the interior tapered edge and the outer perpendicular edge, each rear fin being substantially curved toward the rotational direction.

12. The blower impeller of claim 11, wherein the outer perpendicular edge of the front fins is aligned with one of the outer perpendicular edges on one of the rear fins.

13. The blower impeller of claim 1, wherein the front blade series includes between 5-50 front fins.

14. A handheld blower, comprising: a housing having a first air inlet, a second air inlet, and an output port; a power source positioned within the housing; and a blower impeller positioned within the housing, the blower impeller having: a planar plate having a first side surface, a second side surface, and an outer circumferential edge extending between the first and second side surfaces, wherein the first side surface comprises a central hub having a detent and a flat portion, and the second side surface comprises a cylindrical projection centrally located on the second side surface and extends perpendicularly therefrom, a front blade series extending from the first side surface, wherein said first side surface comprises a sloped transition portion, wherein the front blade series comprises a plurality of front fins providing a first pressurized air flow, wherein each front fin comprises an interior tapered edge extending from an outer edge of said sloped transition portion, wherein each front fin includes a first radius of curvature curved toward a rotational direction, and an angled tip having a second radius of curvature curved away from the rotational direction; and a rear blade series extending from the second side surface, wherein the rear blade series comprises a plurality of rear fins providing a second pressurized air flow, and wherein the second side surface comprises a gap located between the cylindrical projection and the plurality of rear fins, wherein the front fins and the rear fins are of differing scale-lengths.

15. The handheld blower as in claim 14, wherein the angled tip directs air off the front fins in a direction opposite to the rotational direction, and the rear fins direct air toward the rotational direction.

16. The handheld blower as in claim 14, wherein the blower impeller operates at a speed of less than about 7400 rpm and produces less than about 65 decibels (dB) of sound.

17. The handheld blower as in claim 14, wherein the first pressurized air flow blows air circumferentially through the housing, and the second pressurized air flow draws air into the second air inlet.

18. The handheld blower as in claim 14, wherein the front fins generate a first sound frequency and the rear fins generate a second sound frequency.

19. The handheld blower as in claim 18, wherein the first sound frequency is about 1800 Hz and the second sound frequency is about 3600 Hz.

* * * * *